United States Patent [19]

Fürst et al.

[11] Patent Number: 4,557,811

[45] Date of Patent: Dec. 10, 1985

[54] REGENERATION OF AN AMMONIACAL ETCHING SOLUTION WITH RECYCLING OF SOLUTION WITH ELECTROLYTICALLY REDUCED METAL CONTENT TO THE REGENERATION INPUT

[75] Inventors: Leander Fürst, Jülich; Walter Holzer, Meersburg, both of Fed. Rep. of Germany

[73] Assignees: Kernforschungsanlage Jülich Gesellschaft mit beschrankter Haftung, Postfach; Elo-Chem Atztechnik GmbH, Meersburg, both of Fed. Rep. of Germany

[21] Appl. No.: 669,312

[22] Filed: Nov. 7, 1984

[30] Foreign Application Priority Data

Nov. 8, 1983 [DE] Fed. Rep. of Germany ..... 3340342

[51] Int. Cl.[4] ..... C25C 1/00; C25C 7/00

[52] U.S. Cl. ..... 204/105 R; 204/130; 204/237; 204/277; 204/419; 204/434

[58] Field of Search ..... 204/130, 419, 434, 146, 204/140, 105 R, 105 M, 106–127, 237, 277

[56] References Cited

U.S. PATENT DOCUMENTS

| | | | |
|---|---|---|---|
| 2,964,453 | 12/1960 | Garn et al. | 204/130 |
| 3,772,105 | 11/1973 | Shipley | 156/19 |
| 3,783,113 | 1/1974 | Newton et al. | 204/106 |
| 4,055,751 | 10/1977 | Bussmann et al. | 204/434 |

OTHER PUBLICATIONS

"Appl. of Specific Ion Electrodes to Electroplating Analysis" by M. S. Frant, *Plating*, vol. 58 #7, Jul. 1971, pp. 686–693.

*Primary Examiner*—R. L. Andrews

*Attorney, Agent, or Firm*—Frishauf, Holtz, Goodman & Woodward

[57] ABSTRACT

The intermittent electrolysis of a portion of the used ammoniacal etching solution generates oxygen at the anode which is mixed into the remainder of the circulated etching solution for reoxidation and regeneration before it is returned to the etching chamber. The portion of the solution which goes through the electrolysis cell, and has its metal content reduced, is returned to the beginning of the circulation loop rather than to the etching chamber, in order that the metal content of the circulated solution may be quickly reduced. This reduction is quickly picked up by a metal content measuring device in the branch supplying solution to the electrolysis cell. When the metal content is below a certain level, the solution in that branch is returned directly to the beginning of the circulation loop, but when the metal content exceeds the threshold, it is valved into and through the electrolysis cell until the metal content as measured in the line leading to the electrolysis cell drops below its lower threshold value.

6 Claims, 3 Drawing Figures

REGENERATION OF AN AMMONIACAL ETCHING SOLUTION WITH RECYCLING OF SOLUTION WITH ELECTROLYTICALLY REDUCED METAL CONTENT TO THE REGENERATION INPUT

This invention concerns a method and apparatus for regenerating an ammoniacal etching solution by supplying oxygen for reoxidation of the etchant contained in the solution, while another part of the solution is passed through an electrolysis cell for recovery of etched-off metal.

Alkaline etchants are known for etching metallic objects, particularly for producing circuit boards which are also known as "printed circuits". They are used particularly if the circuit boards to be etched have metal parts incapable of withstanding acid etchants, for example metal parts of lead, tin or nickel. Reoxidation of the alkaline etching solution after etching away of metal is carried out with the addition of ammonia gas and/or ammonium chloride in the presence of oxygen or air.

It is known from U.S. Pat. No. 4,385,969 to suspend catalyst particles in the etching solution which accelerate the etching itself and also the reoxidation of the etching solution, thereby making it unnecessary to add chemical oxidizers which lead to toxic residual solutions. In the known method just mentioned, the metals etched away are deposited out of the solution in an electrolysis cell. For that purpose, a part of the etching solution that contains ammonium sulfate flows through the electrolysis cell. The etched metals are deposited on the cathode of the electrolysis cell while oxygen is produced at the anode. The etching solution with reduced metal ion content flows back to the etching chamber.

The quantity of metal which is to be deposited out of solution in the electrolysis cell is controlled in a manner dependent upon the metal content of the etching solution to be regenerated. The metal content in the etching solution should not get below a certain minimum value. In this connection, the effort is made to obtain regulation with as little delay as possible. If the etching solution of reduced metal content is introduced into the etching chamber or into the regenerated etching solution flowing into the etching chamber, the regulation loop delay depends upon the particular location and from the local distance between the etching chamber and the regeneration installation. Even the number of etching chambers connected to the regeneration installation influences the nature of the regulation and control.

SUMMARY OF THE INVENTION

It is an object of the present invention to provide a process and apparatus for regenerating an etching solution that incorporates regulation rapidly responsive to a change of the metal concentration in the etching solution and operates independently of the dimensions and specifications in the set-up of the regeneration installation and of the etching chamber at a particular location.

Briefly, the etching solution of reduced metallic ion content taken from the electrolysis cell is directly introduced into the etching solution flowing out of the etching chamber on its way to be regenerated, so that by means of the devices measuring the metal ion concentration in the etching solution, the actual value of the metal content in the etching solution obtained by the mixing in of etching solutions of reduced metal content can be determined in a very short time. The dead time of the regulation loop is thereby substantially shortened.

An installation for carrying out the process of the invention is constituted with an input line for the etching solution taken from the etching chamber for regeneration and a return line for regenerated etching solution leading to the etching chamber. The etching solution is regenerated with the introduction of oxygen. A part of the etching solution is branched off from the input line to the regeneration equipment and flows to an electrolysis cell for deposition of etched-off metal. In order to obtain regulation with a short regulation delay independent of the location, of the regeneration equipment and of the etching chamber characteristics, a withdrawal line is connected to the electrolysis cell for drawing out etching solution of reduced metallic ion content and leading it to the input line of the regeneration equipment.

In a further development of the invention, the withdrawal line at the electrolysis cell is connected to an electrolyte overflow channel. Etching solution of reduced metal ion content is removed from the electrolysis cell directly after flowing in of the etching solution to be regenerated and mixed with the etching solution to be regenerated. This leads to a further shortening of the dead time of the regulation loop. The withdrawal line discharges into a collecting container into which runs the etchant to be regenerated led out of the etching chamber through a communicating pipe system. Etching chamber and collecting container, therefore, always have the same etching solution level, and supplementary feeding equipment for causing etching solution to overflow from the etching chamber into the regeneration equipment is completely dispensed with.

A highly compact arrangement and simple manual adjustment of the regeneration installation are produced when the collecting container, electrolysis cell and fluid moving equipment for the etching solution and for the introduction of oxygen are all located within a common housing that needs merely to be connected to the etching chamber through the inlet to the regeneration system and the return line from the regeneration system.

BRIEF DESCRIPTION OF THE DRAWING

The invention is further described by way of an illustrative example with reference to the annexed drawing, in which.

DESCRIPTION OF A PREFERRED EMBODIMENT

Figure 1:
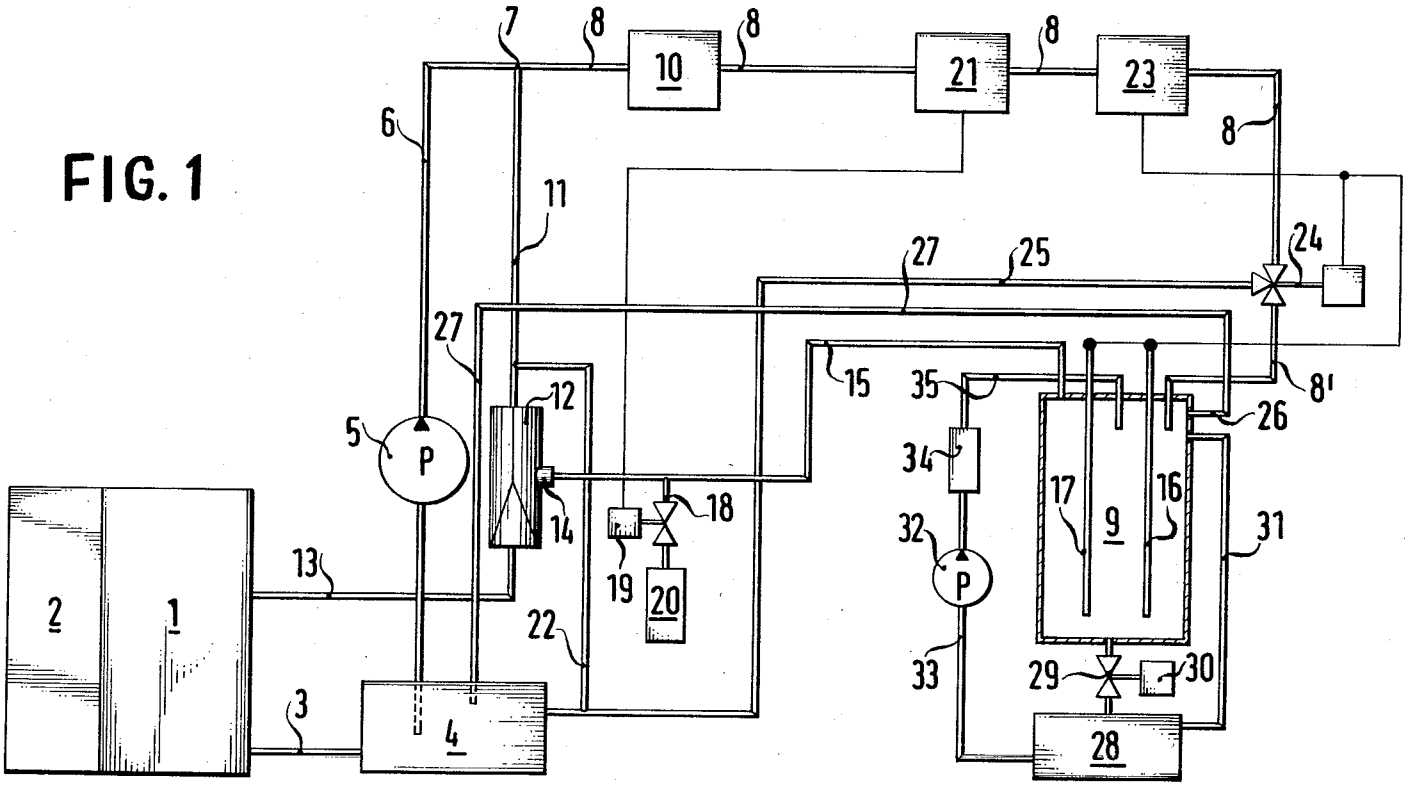
FIG. 1 is a schematic diagram of one embodiment of apparatus for practicing a process of the invention.

FIG. 1 shows a regeneration installation connected to an etching chamber 1 equipped with a rinsing chamber 2. The etching solution to be regenerated, which contains ammonium sulfate combined with copper tetrammin complex as an etchant, flows out of the etching chamber 1, through an inlet pipe 3 into a collecting container 4 that is connected to the etching chamber through a system of communicating pipes. In the illustrated example, the etching solution flows in the inlet pipe 3 into a connecting pipe by gravity out of the etching chamber 1 and into the collecting container 4. From the collecting container 4, the etching solution to be regenerated is led by means of a pump 5 through a pressure line 6 to a pipe coupling 7, going out from which an etchant line 8 leads on to an electrolysis cell 9. A throughput controller 10 inserted in the etchant line 8 determines the portion of the etching solution flowing to the electrolysis cell 9. Another connecting line 11 is connected to the pipe coupling 7 which leads to a liquid jet pump 12, by means of which oxygen is introduced for reoxidation of the etching solution flowing back in the return line 13 to the etching chamber. At the suction inlet 14 of the liquid jet pump, a gas line 15 is connected, the other end of which opens into the gas chamber above the electrolyte in the electrolysis cell 9 and is there supplied with oxygen which is produced at the anode 16 of the electrolysis cell 9, upon deposition of metal at the cathode 17. The etching solution propelled through the pressure line 6 by the pump 5 and then into the connecting line 11 serves as the working medium of the liquid jet pump 12.

An ammonia line 18 connects into the gas line 15 for supply of ammonia from a supply tank 20 for ammonia equipped with an outlet valve control 19. Fresh ammonia can thus be introduced into the etching solution in order to control the pH value of the etching solution, the ammonia being drawn into the etching solution by the liquid jet pump 12 along with the gas containing oxygen sucked out of the electrolysis cell. A pH value measuring device 21 equipped with a measuring electrode suitably is inserted in the etchant line 8 and the valve control 19 for the ammonia is connected to the pH meter 21 for pH regulation. If the pH value falls below a prescribed permissible limit value, the valve 19 opens and ammonia is introduced into the etching solution. The pH meter switches the valve 19 on and off by means of electrical control components not shown in the drawing.

A pressure relief line 22 opens into the connecting line 11 upstream of the liquid jet pump 12 and serves to drain etching solution into the collecting container 4.

In the neighborhood of the through put meter 10 and the pH meter 21, there is also inserted into the etchant line 8 an apparatus 23 for measuring the metal ion concentration.

As already mentioned, the metal ion concentration in the etching solution determines the manner of operation of the electrolysis cell. The apparatus 23 accordingly is operatively connected to a magnetically controlled three-port valve 24 inserted at one end of the etchant line 8. Connected to the valve 24 are, on the one hand, the end piece 8' of the etchant line 8 leading to the electrolysis cell 9 and, on the other hand, a bypass line 25 that leads into the collecting container 4. The three-port valve 24 is normally open towards the electrolysis cell 9. If the metal ion concentration of the etching solution falls below a predetermined value, the three-port valve 24 is switched over. The etching solution then flows through the bypass line 25. The electrolysis cell is switched off.

An electrolyte overflow 26 leads away from the output of the electrolysis cell and delivers etching solution of reduced metal ion content through a withdrawal line 27 to the collecting container 4. This etching solution of reduced metal content is mixed in the collecting container with the etching solution to be regenerated and thereby reduces the metal ion concentration of the latter. The etching solution to be regenerated is sucked out of the collecting container 4 by the pump 5 and is fed into the etchant line 8, through the throughput meter 10 and the pH value meter 21 to the apparatus 23 which reacts to the reduced metal ion concentration in the etching solution when that goes below a predetermined value.

A drain container 28 is also located underneath the electrolysis cell 9. It serves for emptying the electrolysis cell and is connected to the bottom of the electrolysis cell 9 by a drain pipe 29 that is normally shut off by a magnetic valve 30. Etching solution can also flow into the drain container 28 out of the electrolysis cell 9 through a second overflow 31.

An electrolyte pump 32 has the function of providing circulation of etching solution in the electrolysis cell 9. The electrolyte pump has its suction line 33 dipping into the drain container 28, into which the etching solution flows through the overflow 31 and feeds the etching solution through a filter 34 in its pressure line 35 back to the electrolysis cell.

In the illustrated example, the etching solution enters into the electrolysis cell between the anode 16 and the cathode 17. After the electrolysis cell is shut off, the etching solution is emptied into the drain container 28 by opening of the magnetic valve 30. Before renewed operation of the electrolysis cell, the etching solution is fed back into the electrolysis cell out of a drain container by means of the electrolyte pump 32.

EXAMPLE

An etching solution containing ammonium sulfate and copper tetrammin complex was used for etching of copper in the apparatus of the described embodiment. 150 liters of etching solution was put in circulation between the etching chamber and the regeneration installation. The fresh etching solution contained 150 g of ammonium sulfate and 50 g of copper per liter. In the etching chamber, etching solution at a temperature of 50° C. adjusted to a pH value of 9 was sprayed onto workpieces to be etched by means of nozzles. Copper laminated circuit boards were etched. The etching velocity in this case measured 30 μm of copper surface removal per minute.

The electrolysis cell installed in the regeneration system had a deposition power of 600 g of copper per hour. The electrolysis cell operated at 860 A of direct current, which corresponds to a current density of 10 $A/dm^2$ for an electrode surface of 860 $cm^2$. By deposition of metal at the cathode, the etching solution metal content was reduced in its passage through the electrolysis cell by 20 g of copper per liter.

In the regeneration installation, the etching solution was set at a pH value of 9 as a desired value, by addition of ammonia. The throughput controller operated at a desired value of 30 liters of etching solution per hour with a regulation deviation of ±2 l/h. When upon determination of the metal content by the 1 apparatus 23, a copper concentration of 53 g Cu/l was measured in the etching solution, etching solution was directed to the electrolysis cell by a corresponding position of the three-port valve, until the copper concentration had dropped to 50 g Cu/l. At this value, the three-port valve 24 was switched over and the electrolysis cell was shut down. The etching solution reduced in metal ion content in the electrolysis cell was led back into the collecting container. Short dead periods resulted for the regulation loop.

In the course of eight hours of operation, 5.5 kg of copper were deposited on the cathode. This quantity of deposited copper corresponds to 67% of the theoretically depositable amount of copper with reference to the current that had flowed through the electrolysis cell.

Figure 2:
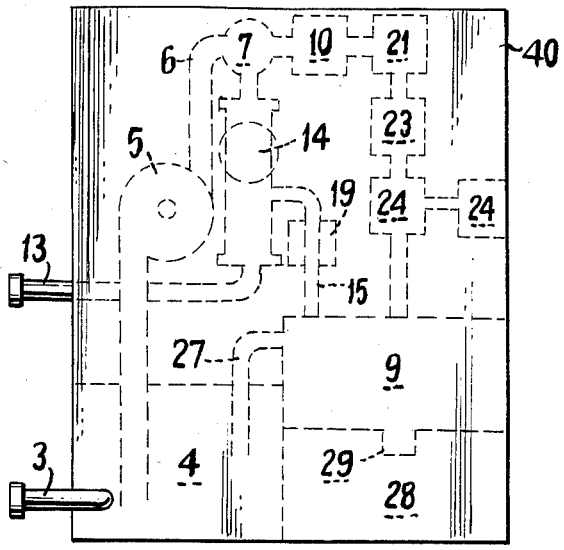
FIGS. 2 and 3 are schematic views of a compact physical construction of the embodiment of FIG. 1.
Figure 3:
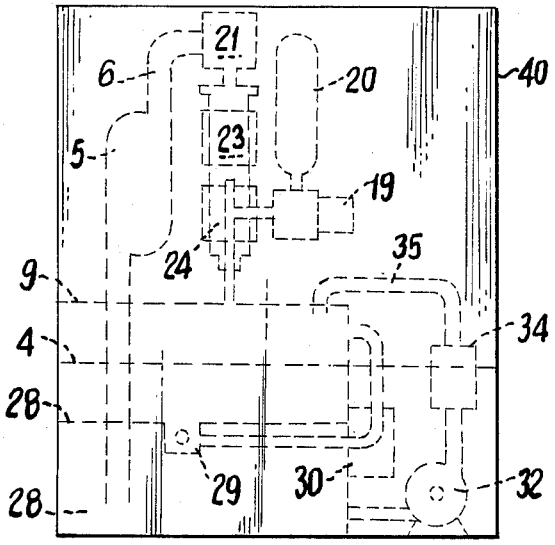

The parts of the regeneration installation schematically shown in FIG. 1 are brought together, in physical construction of the illustrated embodiment, within a single housing that provides the collecting container 4, electrolysis cell 9 and the propelling means for the etching solution and the introduction of oxygen. These propelling means include the pump 5 for leading the etching solution to be regenerated, the liquid jet pump 12 for introducing the gas-containing oxygen and ammonia into the etching solution, as well as the electrolyte pump 32 for the circlation of the etching solution in its composition as electrolyte in the electrolysis cell 9, as shown in FIGS. 2 and 3.

The housing 40 contains also the throughput meter 10, the pH meter 21 and the metal ion concentration measuring device 23. Beneath the electrolysis cell there is located—in the housing, arranged alongside the collecting container 4—the drain container 28 for the electrolyte. The parts of the regeneration installation are disposed in a space-saving manner within the housing. All that needs to be done to put the unit into use is to connect it to an etching chamber through the inlet pipe 3 and the return pipes 13 of the regeneration unit. The local distance between etching chamber and regeneration unit in the particular case makes no difference whatever affecting the proper and effective operation of the regeneration unit.

Although the invention has been described with reference to a particular illustrative example, it will be recognized that variations and modifications are possible within the inventive concept. For example, if the etching solution contains solid particles as used in the etching chamber, the pipe coupling 7 can be replaced by a filter to keep the particles out of the electrolysis cell, as shown in copending patent application Ser. No. 598,087, filed April 9, 1984, owned by the Assignee of the present application.

We claim:

1. Process for regenerating an ammoniacal etching solution wherein etching solution to be regenerated, withdrawn from an etching chamber, is circulated in a loop in the course of which a gas containing oxygen is mixed into said solution for reoxidation thereof, after which the solution is returned to said etching chamber, comprising, in accordance with the invention, the further steps of:

branching off, at a location in said loop upstream of the admixture of oxygen to said solution, only a fractional portion of said solution from said loop and passing it through an electrolysis cell, where it is at least intermittently subjected to electrolysis for separating out etched-off metal, and returning etching solution of at least intermittently reduced metal content, taken out of the electrolysis cell, to said circulation loop at a location upstream of the place of branching off of said solution portion, whereby the metal content of said branched off solution portion is quickly reducible whenever said metal content becomes excessive.

2. Process according to claim 1, further including the steps of:

measuring the metal content of said branched off solution portion to provide a first signal when said metal content exceeds a predetermined upper limit and a second signal when said metal content falls below a predetermined lower limit;

electrolyzing said branched off solution portion after the occurrence of said first signal and until the next occurrence of said second signal for reducing the metal content of the solution returned to said loop, and returning said branched off solution portion without electrolytic reduction of its metal content after the occurrence of said second signal and until the occurrence of said first signal.

3. Apparatus for regenerating an ammoniacal etching solution, connectable to an etching chamber and comprising an inlet duct for solution to be regenerated, a return duct for returning regenerated etching solution to said etching chamber, a circulation loop duct connected at its upstream end to said inlet duct and at its downstream end to said return duct, means for circulating said solution to be regenerated through said loop duct and means interposed in said loop for introducing a gas containing oxygen into said solution to be regenerated, and, according to the invention, a branch duct branching off from said loop duct upstream of said gas introducing means, an electrolysis cell for receiving etching solution from said branch duct and reducing the metal content thereof and a withdrawal line for etching solution of reduced metal content leading from said electrolysis cell to a place of connection to said inlet line upstream of said circulation means.

4. Apparatus according to claim 3, in which said withdrawal line is connected at its upstream end to an electrolyte overflow port of said electrolysis cell.

5. Apparatus according to claim 3, in which a collection container is provided for said inlet duct, and also a pipe system for leading etching solution out of said etching chamber into said collecting container, and wherein said withdrawal line leads into said collecting container.

6. Apparatus according to claim 5, in which said collecting container, electrolysis cell, solution circulating means, gas introducing means, and electrolysis cell, and also means for moving solution into, and out of said electrolysis cell are constructed within a common housing for providing a compact regeneration apparatus connectible to said etching chamber by said inlet duct and said return duct.

* * * * *